United States Patent [19]

Fujimoto

[11] 3,951,585

[45] Apr. 20, 1976

[54] METHOD OF HEATING AND FIXING A TONER IMAGE

[75] Inventor: Sakae Fujimoto, Chofu, Japan

[73] Assignee: Ricoh Co., Ltd., Tokyo, Japan

[22] Filed: Nov. 20, 1974

[21] Appl. No.: 525,682

Related U.S. Application Data

[62] Division of Ser. No. 357,097, May 4, 1973, Pat. No. 3,874,843.

[30] Foreign Application Priority Data

May 11, 1972 Japan ..... 47-46997

[52] U.S. Cl. ..... 432/8; 432/60; 432/228; 219/469; 427/27

[51] Int. Cl.[2] ..... G03G 5/00; H05B 3/10

[58] Field of Search ..... 432/59, 60, 8, 227, 432/228; 355/17; 219/216, 469, 388; 117/21; 427/27

[56] References Cited

UNITED STATES PATENTS

| | | | |
|---|---|---|---|
| 3,291,466 | 12/1966 | Aser et al. | 432/60 |
| 3,452,181 | 6/1969 | Stryjewski | 432/8 |
| 3,751,216 | 8/1973 | Gregory | 432/60 |
| 3,754,819 | 8/1973 | Braun | 432/60 |
| 3,861,863 | 1/1975 | Kudsi | 432/228 |
| 3,874,843 | 4/1975 | Fujimoto | 432/60 |

*Primary Examiner*—John J. Camby
*Assistant Examiner*—Henry C. Yuen
*Attorney, Agent, or Firm*—Cooper, Dunham, Clark, Griffin & Moran

[57] ABSTRACT

A method and a device using a pair of fixing rolls at least one of which is heated so that the two rolls are brought into pressing engagement with each other by thermal expansion of the heated roll. A copy sheet bearing a toner image formed thereon is fed between the two rolls so as to fix the toner image by thermal fusion.

1 Claim, 8 Drawing Figures

METHOD OF HEATING AND FIXING A TONER IMAGE

This is a division of application Ser. No. 357,097, filed May 4, 1973, now U.S. Pat. No. 3,874,843.

BACKGROUND OF THE INVENTION

This invention relates to methods of heating and fixing a toner image, and more specifically it is concerned with a method of heating and fixing a toner image for electrophotographic apparatus wherein a copy sheet on which the toner image is formed is fed between a pair of fixing rolls so as to fix the toner image by fusion adhesion.

The quickest and most positive method for fixing a toner image formed on a copy sheet as by transfer-printing comprises directly heating the toner image by at least one heating roll to cause the toner image to adhere to the copy sheet or supporter by fusion. In one method known in the art, a copy sheet on which a toner image is formed is passed between a pair of heating rolls to bring the toner image into direct contact with high temperature surfaces of the heated heating rolls. The copy sheet is both heated by and pressed between the rolls, this combination of heat and pressure serving to effect the desired fixing of the toner image.

For example, a known form of toner image fixing apparatus comprises an upper fixing roll having an outer layer of material such as silicone rubber and a lower fixing roll fabricated of metal with a smooth surface, disposed to press an advancing image-bearing copy sheet between them. Means such as a coil heater is mounted within the interior of at least one of the rolls for heating the same. The outer surface of the upper fixing roll, which engages the image-bearing surface of the copy sheet, is treated so as to be non-tacky for prevention of offset. Offset, as will be understood, is a condition wherein toner from one copy sheet partially adheres to a fixing roll and is transferred thereby to the next succeeding copy sheet.

In operation, the two fixing rolls are maintained in pressing contact with each other and rotated in opposite directions while a toner-image-bearing copy sheet or a succession of such sheets are advanced between them, one or both rolls being heated by the aforementioned heating means for heating the toner images. However, if the two fixing rolls are maintained in pressing contact when they are not in use (i.e. when they are stationary), the roll having an outer layer of silicone rubber or like material may become permanently deformed; such deformation results in irregularity of pressing contact between the rolls upon rotation thereof, and consequent variation in pressure on a toner image passing therebetween. That is to say, the described deformation of one of the two fixing rolls is undesirable because it adversely affects the fixing of toner images.

In order to obviate this disadvantage, conventional fixing devices of the type described are constructed such that the lower fixing roll is used as a drive roll and the upper fixing roll is moved away from the lower roll when not in use. This makes it necessary to use a mechanism for moving the upper fixing roll and complicates the construction of the device. Besides, this poses the problem of how to adjust the force with which the upper fixing roll bears against the lower fixing roll, because the force with which the upper fixing roll bears against the lower fixing roll immediately after they are brought into pressing engagement with each other naturally varies from the force with which the former bears against the latter when the rolls are heated and their temperature has reached a predetermined fixing temperature (about 180°C). More specifically, thermal expansion of the rolls is not much when the rolls are brought into engagement with each other because the temperature of the rolls is low. However, the rolls will undergo thermal expansion and their diameter will increase as heating progresses. Thus, the force with which the upper fixing roll bears against the lower fixing roll shows a change as heating of the rolls progresses, provided that the pressure applied to the rolls remains constant. This may lead to the development of slip between the copy sheet and the lower fixing roll when the sheet moves between the two fixing rolls because the lower fixing roll is a drive roller. When this happens, the copy sheet will be broken or the image on the sheet will be distorted.

In fixing devices of this type, it is essential that the upper fixing roll and lower fixing roll have the same peripheral velocity at the point of contact between them during the time the toner image on the copy sheet is fused and adheres to the copy sheet.

In order to meet this requirement, it has hitherto been customary in conventional fixing devices of this type to use a one-way clutch or the like to drive both the upper and lower fixing rolls when they are placed in service, so as to prevent the two rolls from moving at different linear speeds at the point of contact of the rolls.

To sum up, conventional fixing devices of this type must use a complex and troublesome mechanism to preclude permanent deformation of the fixing rolls which function as heating rolls.

SUMMARY OF THE INVENTION

This invention has as its object the provision of a method of heating and fixing a toner image which utilize thermal expansion of the heating rolls to expose the fixing rolls to pressure only when they are heated.

According to the invention, the fixing rolls are out of pressing engagement with each other when they are not heated and brought into pressing engagement with each other only when they are heated and undergo thermal expansion. Thus the fixing rolls are free from the danger of undergoing permanent deformation. The device according to the invention is very simple in construction

DESCRIPTION OF PREFERRED EMBODIMENTS OF THE INVENTION

Figure 1:
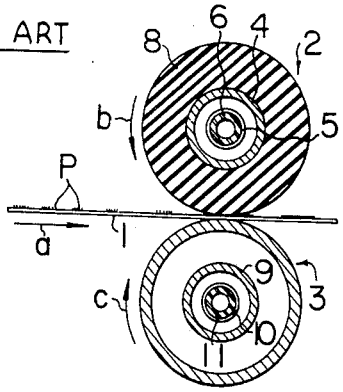
FIG. 1 PRIOR ART
FIG. 1 is a sectional view of a heating and fixing device using a pair of fixing rolls of the prior art.

FIG. 1 illustrates an exemplary form of prior art apparatus for fixing a toner image. In the device of FIG. 1, a copy sheet 1 on which a toner image P is formed is conveyed in the direction of an arrow *a* along a path of travel of copy sheets on which an upper fixing roll 2 is disposed. The copy sheet 1 is disposed such that its image-bearing surface is brought into direct contact with the peripheral surface of the roll 2. The upper fixing roll 2 is supported at its central portion by a shaft on which a metallic tubular shaft 4 is mounted. A heat source for heating the roll 2 so that it may serve as a heating roll is built in the tubular shaft 4. The heat source comprises a coil heater 5 which is wound on a glass rod 6 disposed on the center axis of tubular shaft 4. An outer layer 8 made of a heat-resisting and durable material, such for example as silicone rubber, is provided on the surface of tubular shaft 4. The outer layer 8 of the roll has an outer peripheral surface which is treated to be nontacky so as to prevent occurrence of an offset phenomenon.

The offset phenomenon tends to occur when toner powders of the image on the preceding copy sheet are fused by heating and become tacky. When fused, part of the toner image may adhere to the periphery of the heating roll and be transferred to the next following sheet whose toner image may adhere in part to the periphery of the heating roll and be transferred to the next following copy sheet. This cycle is referred to as an offset phenomenon. Occurrence of this phenomenon is not desirable and should be prevented by all means in fixing a toner image by using heating rolls in electrophotography.

Disposed beneath the upper fixing roll 2 constructed as aforementioned is a lower fixing roll 3 for a nonimage-bearing surface of the copy sheet 1 to be brought into contact with the outer periphery of the roll 3. The roll 3 is a metallic roll whose outer peripheral surface is finished to be as smooth as glass. It has built in its central portion a heat source similar to that provided in the upper roll 2. That is, a coil heater 10 is wound on a glass rod 11 disposed on the center axis of a tubular shaft 9 mounted on a shaft extending through the central portion of roll 3, so that the roll 3 can serve as a heating roll.

The two rolls 2 and 3 constructed as aforementioned are maintained in pressing contact with each other and rotate in opposite directions as indicated by arrows *b* and *c*. The copy sheet 1 on which the toner image P is formed is passed between the two rolls 2 and 3 with its image bearing surface facing upwardly. When the copy sheet 1 moves between the two rolls 2 and 3, the toner image P thereon is brought into contact with the outer periphery of the roll 2 heated by coil heaters 5 and 10. When heated, the toner image P is fused and adheres to the copy sheet 1. Thus the toner image is fixed by heat as well as by pressure applied to the copy sheet by the rolls.

As aforementioned, the two fixing rolls are maintained in pressing engagement with each other at their peripheries in order to promote fixing of the toner image in the fixing device described above. Since the upper fixing roll 2 has its cover layer made of silicone rubber or other like material, its peripheral surface may undergo permanent transformation if it is maintained in pressing engagement with the peripheral surface of the lower fixing roll. As a result, the upper fixing roll may move at all times in irregular rotary motion when it is placed in service, thereby interfering with fixing of the toner image. As explained above, expedients have been devised for moving one roll away from the other when the device is not in use, but these prior art expedients are mechanically complex and introduce other problems.

Apparatus suitable for the practice of the present invention will now be described with reference to the specific embodiments thereof shown in FIGS. 2–5.

Figure 2:
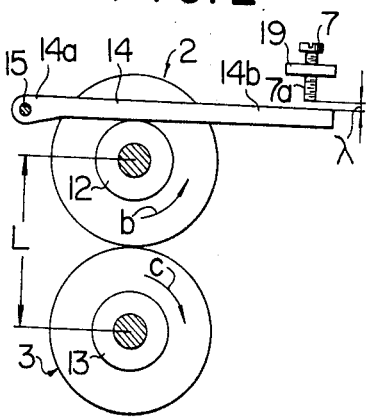
FIG. 2 is a side view of heating and fixing apparatus comprising one embodiment of apparatus suitable for practice of the invention.

In FIG. 2, the upper fixing roll 2, which is of the same construction as the upper fixing roll described above, is supported on a bearing 12 which in turn is supported for vertical movement by a side plate (not shown). The roll 2 is driven in the direction of an arrow *b* by a drive (not shown).

Disposed below the upper fixing roll 2 is the lower fixing roll 3 which is of the same construction as the lower fixing roll described above and which is supported on a bearing 13 which in turn is supported by a side plate (not shown). The upper roll 2 rests on and bears against the lower roll 3 by its own weight, and the latter rotates in the direction of an arrow *c* when the former is driven in the direction of arrow *b* without being heated.

An arrester 14 is mounted on the bearing 12 for the upper roll 2 to preclude an increase in the interaxial distance L between the two rolls 2 and 3 when they are heated and undergo expansion. The arrester 14 has a base 14*a* pivotally supported by a shaft 15, and a free end portion 14*b* extending from the base 14*a* and disposed on the bearing 12. Disposed above the free end portion 14*b* is a stop 7 comprising a screw threaded into an immovable member 19. The stop 7 performs the function of adjusting the interaxial distance L.

When the two rolls 2 and 3 are not heated, the stop 7 is adjusted in its threadable connection with the immovable member 19 such that a front end 7*a* thereof is spaced apart from the free end portion 14*b* of arrester 14 a distance $\lambda$. The distance $\lambda$ is set such that it is smaller in value than an increase in the axial distance L which will be caused to occur by the increase in the diameters of the rolls 2 and 3 owing to heating.

Operation of the embodiment of the apparatus constructed as aforementioned will now be described. The two rolls 2 and 3 are heated to effect fixing and are set rotating in opposite directions as indicated by the arrows *b* and *c*. As the temperature of the two rolls increases and reaches a fixing temperature range, they undergo expansion due to heat and their diameters increase in value. As a result, the upper roll 2 moves upwardly, and the arrester 14 is also moved upwardly by the bearing 12 till its free end portion 14*b* abuts against the stop 7. Thereafter upward movement of the bearing 12 is precluded. However, the two rolls 2 and 3 continue to expand as they are heated until their temperature reaches a predetermined fixing temperature (about 180° C). Thus the expansion of the rolls after the free end portion 14*b* is brought into abutting engagement with the stop 7 is converted into a force with which the two rolls are brought into pressing engagement with each other. As a result, the outer peripheral surfaces of the two rolls 2 and 3 bear against each other, and the copy sheet fed between them is heated and pressed by the rollers, so that the toner image is fixed.

In the embodiment shown and described above, the two rolls 2 and 3 are brought into pressing engagement with each other by precluding an increase in the interaxial distance L caused by heating of the rolls 2 and 3 by means of the stop 7 through the arrester 14. It is to be understood that the free end portion 14*b* may be fixed if the value of an increase in the interaxial distance L caused by heating of the rolls 2 and 3 is known. If this is the case, the arrester 14 will be spaced apart from the bearing 12 a distance λ when the two rolls 2 and 3 are not heated.

Figure 3:
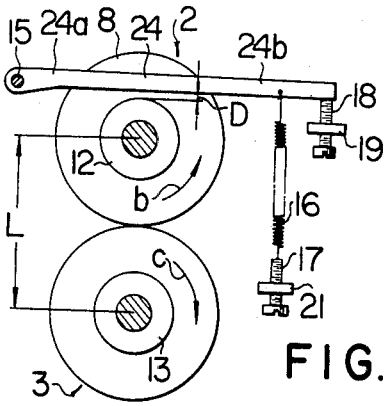
FIG. 3 is a side view of heating and fixing apparatus comprising another embodiment of apparatus suitable for practice of the invention.

Another embodiment of a device suitable for practice of the invention will now be described. As shown in FIG. 3, the arrester 14 of the embodiment shown in FIG. 2 is replaced by a presser 24 mounted on the bearing 12 supporting the upper fixing roll 2. The presser 24 has a base 24*a* pivotally supported by the shaft 15, and a free end portion 24*b* extending from the base 24*a* and disposed above the bearing 12. Connected to the free end portion 24*b* is one end of a compression spring 16 which is secured at the other end to an adjusting screw 17 normally to urge the presser 24 to move downwardly. Downward movement of the presser 24 is, however, limited by its free end portion 24*b* abutting against a stop 18 which comprises a screw threaded into an immovable member 19 and abuts at its front end against the free end portion 24*b* of the presser 24. It is thus possible to adjust a gap D between the bearing 12 and free end portion 24 by suitably adjusting the stop 18 in its threadable connection with the immovable member 19. The gap D may vary depending on the thermal expansion coefficients of the upper and lower rolls 2 and 3, and the gap D has a suitable value when the rolls 2 and 3 are not heated.

On the other hand, the adjusting screw 17 to which the other end of spring 16 is secured is threaded into an immovable member 21, with the other end of spring 16 being connected to the front end of screw 17 threadably connected to the immovable member 21. By adjusting the screw 17 in its threadable connection with the immovable member 21, it is possible to adjust the biasing force of spring 16 which urges the presser 24 to move downwardly.

Figure 4:
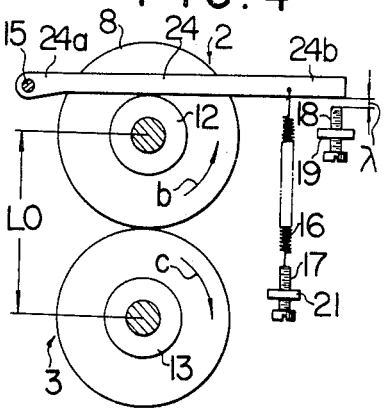
FIG. 4 shows the operation of the apparatus shown in FIG. 3.

Operation of the embodiment shown in FIG. 3 will now be described. When the two rolls 2 and 3 are heated and the upper roll 2 is driven, the two rolls 2 and 3 rotate in opposite directions as indicated by the arrows *b* and *c* while being heated. As the temperature of the heated rolls reaches a fixing temperature range, the rolls 2 and 3 undergo thermal expansion. The upper roll 2 having a layer made of silicone rubber has a greater thermal expansion coefficient. As the rolls 2 and 3 expand, their diameters increase in value and the upper roll 2 moves upwardly as shown in FIG. 4. This causes the interaxial distance L between the rolls 2 and 3 (see FIG. 3) to increase to an interaxial distance LO. As the upper roll 2 moves upwardly, the bearing 12 also moves upwardly and abuts against the presser 24 to move the same upwardly. This moves the free end portion 24*b* away from the stop 18 at a distance λ.

However, since the presser 24 is urged by the biasing force of spring 16 to move downwardly, the peripheral surfaces of the rolls 2 and 3 maintained in engagement with each other bear against each other. Thus the copy sheet fed between the two rolls 2 and 3 which bear against each other is subjected to heat and pressure, so that the toner image thereon is fixed. The force with which the two rolls 2 and 3 bear against each other can be adjusted to an optimum value by adjusting the screw 17 in its threadable connection with the immovable member 21 to vary the biasing force of spring 16.

Thus the invention utilizes the thermal expansion of the fixing rolls to cause the rolls to bear against each other. Since the upper fixing roll 2 is driven, no slip is produced between the copy sheet and the peripheral surfaces of the fixing rolls while the rolls bear against each other.

After the toner image is fixed and the supply of a current to the coil heaters is cut off, the temperatures of the rolls 2 and 3 show a reduction and the rolls undergo contraction till normal values are restored to their diameters. This reduces the value LO of the interaxial distance of the rolls 2 and 3 to the original value L shown in FIG. 3. This causes the bearing 12 to move downwardly, and at the same time the presser 24 is moved clockwise about the shaft 15 by the biasing force of spring 16 till its free end portion 24*b* abuts against the stop 18 and becomes stationary. When the free end portion 24*b* becomes stationary, the gap D is produced between the bearing 12 and the presser 24 as shown in FIG. 3. Accordingly, the fixing rolls 2 and 3 are free from the danger of undergoing permanent transformation, because the upper roll 2 rests on and bears against the lower roll 3 only by its weight when they are not heated.

Figure 5:
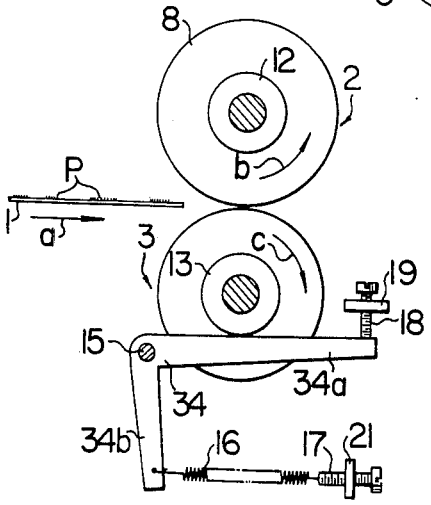
FIG. 5 is a side view of heating and fixing apparatus comprising still another embodiment of apparatus suitable for practice of the invention.
Figure 6:
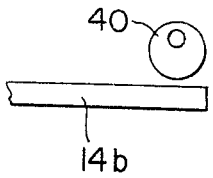
Figure 7:
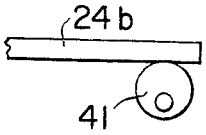
Figure 8:
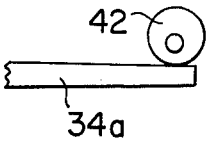

In the embodiment shown and described above, the upper fixing roll 2 to which the drive force is transmitted is moved upwardly as the rolls undergo thermal expansion. In the apparatus constructed for practical use, however, the bearing 12 supporting the upper fixing roll 2 to which the drive force is transmitted is fixed to the side plate, and pressure is applied to the bearing 13 supporting the lower fixing roll 3 by means of a presser 34 in the form of a bell-crank which moves the bearing up and down as shown in FIG. 5. More specifically, the lower fixing roll 3 is supported by the side plate for vertical movement, one arm 34*a* of the presser 34 pivoted at 15 extends to be disposed beneath the bearing 13, and the spring 16 is mounted between the other arm 34*b* and the adjusting screw 17 to urge the presser 34 to move counterclockwise about the pivot 15 by its biasing force. The stop 18 disposed above the arm 34*a* comprises a screw threaded into the immovable member 19 from above.

In the apparatus constructed for practical use as aforementioned, the lower roll 3 is moved downwardly by the upper roll 2 which undergoes expansion when heated, and a reaction to the force moving the lower roll 3 downwardly is produced by the biasing force of spring 16 so as to urge the lower roll 3 to move upwardly. Thus, the peripheral surfaces of the two rolls 2 and 3 maintained in contact with each other are caused to bear against each other. When the rolls are not heated, the presser 34 is caused to move counterclockwise about the pivot 15 by the biasing force of spring 16 till the arm 34*a* abuts against the stop 18. This moves the bearing 13 upwardly so that the periphery of the lower fixing roll 3 is brought to a position which it is disposed near the periphery of the upper fixing roll 2.

When the upper and lower rolls are out of service they are out of engagement with each other. Thus the rolls shown in FIG. 5 are entirely free from the danger of developing deformation, although the rolls shown in FIG. 2 and FIG. 3 may develop slight deformation because the upper roll rests on and bears against the lower roll 3 by its own weight when out of service.

The results of experiments show that, when the upper fixing roll 2 having a cover layer made of silicone rubber is heated to 180° C, its diameter increases in value by about 1 millimeter by thermal expansion. Thus it is possible to apply a pressure ranging from 3 to 5 kg to the rolls by thermal expansion alone if the biasing force of the spring 16 is adjusted.

In all the embodiments shown and described, the upper and lower rolls are both heated. It is to be understood, however, that only one of such rolls may be heated. The stops 7 and 18 for adjusting the interaxial distance of the two rolls are each in the form of a screw. Other means, however, such as eccentric cam can be used as the stops 7 and 18.

It is to be understood that the invention is not limited to the features and embodiments hereinabove specifically set forth but may be carried out in other ways without departure from its spirit.

What is claimed is:

1. A method of heating and fixing a toner image formed on a copy sheet wherein the sheet is fed between a pair of fixing rolls, one of which is movably supported relative to the other to vary the interaxial distance between the rolls, and at least one of which undergoes radial thermal expansion when heated, said method comprising:

a. heating the last-mentioned one of said fixing rolls for effecting radial thermal expansion thereof;

b. limiting an increase in the interaxial distance between said pair of fixing rolls when said one heated fixing roll undergoes radial thermal expansion by the heating step for pushing the pair of fixing rolls to bear against each other due to the thermal expansion of the heated fixing roll, c. the limiting step comprising restraining movement of the axis of said movably supported roll away from the other of said rolls only beyond a point at which the rolls are in contact when said one heated roll has been radially thermally expanded by a predetermined amount owing to heating by the heating step; and d. feeding a toner-image-bearing copy sheet between said pair of fixing rolls while the rolls are pushed against each other as aforesaid for fixing the image on the copy sheet.

* * * * *